US012377315B1

(12) United States Patent
Gao

(10) Patent No.: US 12,377,315 B1
(45) Date of Patent: Aug. 5, 2025

(54) MULTI-RESISTANCE HAND GRIPPER RING

(71) Applicant: MACBO TECHNOLOGIES LLC, Denver, CO (US)

(72) Inventor: Yiming Gao, Shenzhen (CN)

(73) Assignee: MACBO TECHNOLOGIES LLC, Denver, CO (US)

( * ) Notice: Subject to any disclaimer, the term of this patent is extended or adjusted under 35 U.S.C. 154(b) by 0 days.

(21) Appl. No.: 19/055,515

(22) Filed: Feb. 18, 2025

(30) Foreign Application Priority Data

Jul. 10, 2024 (CN) ..... 202410928189.4

(51) Int. Cl.
*A63B 23/16* (2006.01)
*A63B 21/02* (2006.01)

(52) U.S. Cl.
CPC ..... *A63B 23/16* (2013.01); *A63B 21/028* (2013.01)

(58) Field of Classification Search
CPC ..... A63B 21/028; A63B 21/0004; A63B 21/4019; A63B 21/4034; A63B 23/16
See application file for complete search history.

(56) References Cited

U.S. PATENT DOCUMENTS 5,366,436 A * 11/1994 Gibney ..... A63B 21/055 482/121
D715,449 S * 10/2014 Wang ..... D24/188
10,112,073 B2 * 10/2018 Harrison ..... A44C 5/0007
D994,052 S * 8/2023 Lin ..... D21/684
2006/0079380 A1 * 4/2006 Wells ..... A63B 21/4019 482/49
2009/0029830 A1 * 1/2009 Chiang ..... A63B 23/16 482/44
2023/0277897 A1 * 9/2023 Murphy ..... A63B 23/16 482/44

FOREIGN PATENT DOCUMENTS

CN 114669024 A * 6/2022

* cited by examiner

*Primary Examiner* — Megan Anderson
(74) *Attorney, Agent, or Firm* — Ying-Ting Chen

(57) ABSTRACT

A hand grip ring including a gripper ring body which includes a first gripping portion group including two gripping portions and a second gripping portion group including two gripping portions, wherein the two gripping portions of at least one of the first gripping portion group and the second gripping group have concave grooves at an inner side thereof respectively to guide deformation of the two gripping portions, wherein the first gripping portion group and the second gripping portion group have different elastic characteristics.

19 Claims, 16 Drawing Sheets

A-A

B-B

C

D

E

F

MULTI-RESISTANCE HAND GRIPPER RING

CROSS REFERENCE OF RELATED APPLICATION

This application is a non-provisional application that claims priority under 35U.S.C. § 119 to China application number CN202410928189.4, filing date Jul. 10, 2024, wherein the entire content of which is expressly incorporated herein by reference.

BACKGROUND OF THE PRESENT INVENTION

Field of Invention

The present invention relates to hand grip strengthening device, and more particular to a multi-resistance hand gripper ring.

Description of Related Arts

As people's pursuit of a healthy lifestyle continues to grow, exercising and improving physical fitness have become a basic awareness for many people. The grip strengthener, as a device used to train grip strength, has become a commonly used tool in daily exercise routines. Users mainly achieve grip training by grasping specific parts of the grip strengthener and countering its elastic resistance.

However, existing grip strengtheners have some issues in practical application. For example, the rated resistance value of the grip strengthener is fixed, requiring users to replace the grip strengthener when they need to adjust the training intensity. Additionally, the method for adjusting the rated resistance value is often cumbersome. Moreover, grip strengtheners tend to have limited functionality, complex structures, and lack portability.

The rated resistance value refers to the amount of force a user needs to apply to achieve the maximum deformation of the elastic part of the grip strengthener when held. The maximum deformation of the elastic part is influenced not only by its own elastic properties but also by the constraints imposed by the components connected to it

SUMMARY OF THE PRESENT INVENTION

The invention is advantageous in that it provides a hand gripper ring, wherein at least two parts of the hand gripper ring have different elastic properties, so that the user needs to provide different gripping forces when holding different positions. In this way, when the user needs to adjust the intensity of the exercise, he or she only needs to change the gripping position, without having to replace the hand gripper ring or perform cumbersome adjustments to the structure of the hand gripper ring.

Additional advantages and features of the invention will become apparent from the description which follows, and may be realized by means of the instrumentalities and combinations particularly pointing out in the appended claims.

According to the present invention, the foregoing and other objects and advantages are attained by a hand grip ring comprising a gripper ring body which comprises at least two gripping portion groups each comprising two gripping portions opposite to each other, wherein the at least two gripping portion groups have different elastic characteristics.

The present invention further provides a hand grip ring comprising a gripper ring body which comprises:

- a first gripping portion group which comprises two gripping portions at two opposite sides of a center of the gripper ring body; and
- a second gripping portion group which comprises two gripping portions at two opposite sides of the center of the gripper ring body, wherein the two gripping portions of at least one of the first gripping portion group and the second gripping group have concave grooves at an inner side thereof respectively to guide deformation of the two gripping portions, wherein the first gripping portion group and the second gripping portion group have different elastic characteristics.

According to an embodiment, the first gripping portion group and the second gripping group are arranged to allow a user to grip in two directions which are perpendicular to each other.

According to an embodiment, the two gripping portions of each of the first gripping portion group and the second gripping group have concave grooves at an inner side thereof respectively.

According to an embodiment, each of the two gripping portions of the first gripping portion group has a centerline, each of the two gripping portions of the second gripping group has a centerline, wherein when said first gripping portion group is griped and pressed along a first direction passing through the centerlines of the two gripping portions of the first gripping portion group, the two gripping portions of the second gripping group are respectively folded with respect to a second direction passing through the centerlines of the two gripping portions of the second gripping group to reduce the corresponding concave grooves.

According to an embodiment, each of the two gripping portions of the first gripping portion group has a centerline, each of the two gripping portions of the second gripping group has a centerline, wherein when said first gripping portion group is griped and pressed along a first direction passing through the centerlines of the two gripping portions of the first gripping portion group, the two gripping portions of the second gripping group are respectively folded with respect to a second direction passing through the centerlines of the two gripping portions of the second gripping group to reduce the corresponding concave grooves, wherein when said second gripping group is griped and pressed along the second direction passing through the centerlines of the two gripping portions of the second gripping group, the two gripping portions of the first gripping portion group are respectively folded with respect to the first direction passing through the centerlines of the two gripping portions of the first gripping portion group to reduce the corresponding concave grooves.

According to an embodiment, the first gripping portion group and the second gripping group are configured to be of different materials, different volumes, or different densities.

According to an embodiment, an area size of a cross section along the centerline of each of the two gripping portions of the first gripping portion group is different from an area size of a cross section along the centerline of each of the two gripping portions of the second gripping group.

According to an embodiment, an inner surface of each of the two gripping portions of the first gripping portion group has a valley position, two peak position at two sides of the valley position, two transition surfaces each is extended between the valley position and the corresponding peak position to define the corresponding concave groove.

According to an embodiment, each of the two gripping portions of the first gripping portion group comprises a gripping body and a protruding portion integrally extended from the gripping body to define the corresponding concave groove.

According to an embodiment, one or more gripping portion group each comprising two gripping portions are arranged between the first gripping portion group and the second gripping portion group.

According to an embodiment, each of the two gripping portions of the third gripping portion group and the fourth gripping portion group is extended between one gripping portion of the first gripping portion group and one gripping portion of the second gripping portion group.

According to an embodiment, the third gripping portion group and the fourth gripping group are arranged to allow the user to grip in two directions which are perpendicular to each other.

According to an embodiment, a third gripping portion group each comprising two gripping portions arranged opposite to each other and a fourth gripping portion group each comprising two gripping portions arranged opposite to each other are provided, wherein the two gripping portions of the third gripping portion group has a concave groove defined between one peak position of the first gripping portion group and one adjacent peak position of the second gripping group.

According to an embodiment, a groove depth of the concave groove of each gripping portion of each of the third gripping portion group and the fourth gripping portion group is larger than a groove depth of the concave groove of each gripping portion of each of the first gripping portion group and the second griping group.

According to an embodiment, the gripping portions of the first gripping portion group, the second griping group, the third gripping portion group and the fourth gripping portion group are distinguishable through surface patterns.

The present invention further provides a hand grip ring comprising a gripper ring body which comprises:

- a first gripping portion having a first concave groove at an inner side thereof defining a first valley position, two first peak positions, and two first transition surfaces each is extended between the first valley position and the corresponding first peak position;
- a second gripping portion having a second concave groove at an inner side thereof defining a second valley position, two second peak positions, and two second transition surfaces each is extended between the second valley position and the corresponding second peak position, wherein the first concave groove is aligned with the second concave groove;
- a third gripping portion; and
- a fourth gripping portion opposite to the third gripping portion, wherein when the third gripping portion and the fourth gripping portion are gripped, said first gripping portion and said second gripping portion are respectively deformed to reduce the first concave groove and said second concave groove in a manner that said two first transition surfaces are moved toward each other and said two second transition surfaces are moved toward each other.

According to an embodiment, the third gripping portion has a third concave groove at an inner side thereof defining a third valley position, two third peak positions, and two third transition surfaces each is extended between the third valley position and the corresponding third peak position, the fourth gripping portion has a fourth concave groove at an inner side thereof defining a fourth valley position, two fourth peak positions, and two fourth transition surfaces each is extended between the fourth valley position and the corresponding fourth peak position, wherein the third concave groove is aligned with the fourth concave groove, wherein when the first gripping portion and the second gripping portion are gripped, said third gripping portion and said fourth gripping portion are respectively deformed to reduce the third concave groove and said forth concave groove in a manner that said third transition surfaces are moved toward each other and said fourth transition surfaces are moved toward each other.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
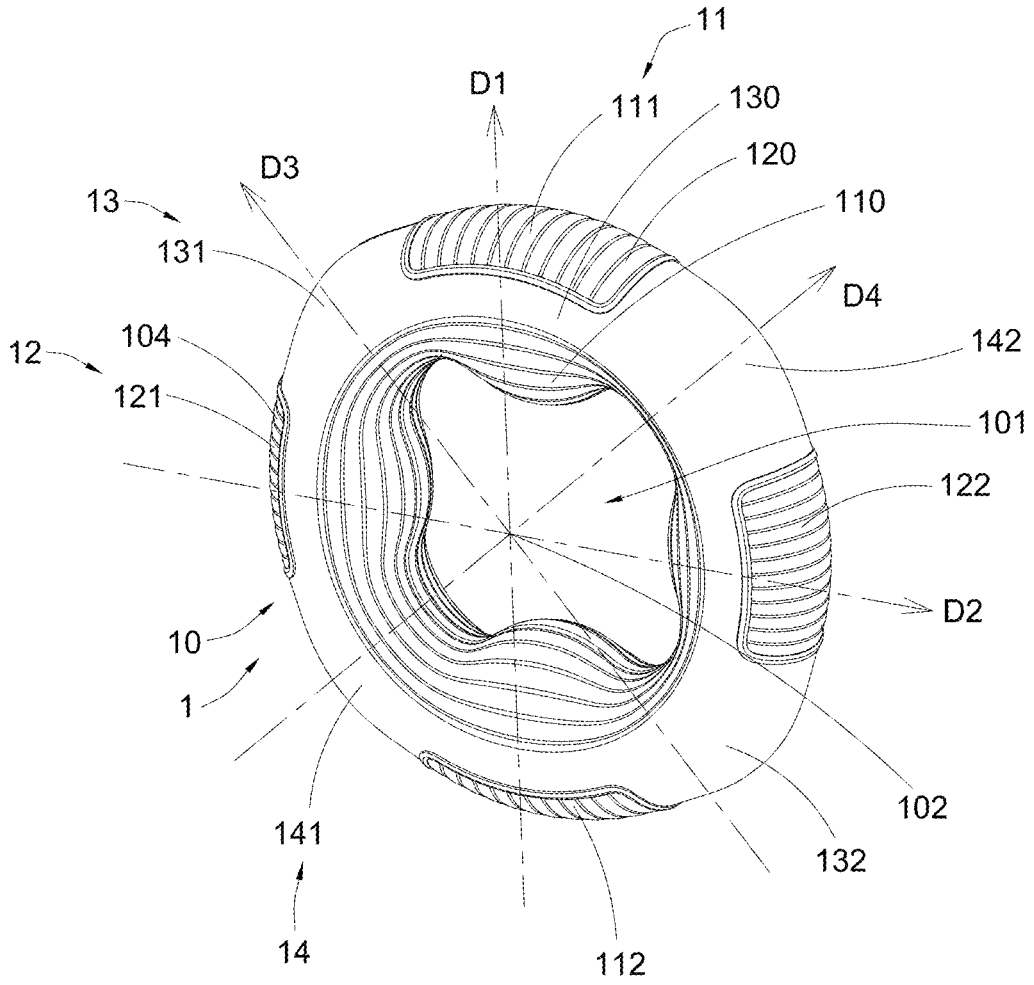
FIG. 1 is a perspective view of a hand gripper ring according to a first embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. that indicate relations of directions or positions are based on the relations of directions or positions shown in the appended drawings, which are only to facilitate descriptions of the present invention and to simplify the descriptions, rather than to indicate or imply that the referred device or element is limited to the specific direction or to be operated or configured in the specific direction. Therefore, the above-mentioned terminologies shall not be interpreted as confine to the present invention.

Referring to FIG. 1 to FIG. 4 of the drawings, a hand gripper ring 1 according to a first embodiment of the present invention is illustrated, the elastic properties of at least two parts of the hand gripper ring 1 are different, so that the user should provide different gripping forces when holding different positions. In this way, when the user needs to adjust the intensity of the exercise, he or she only needs to change the gripping position, without having to replace a new hand gripper ring 1 or make cumbersome adjustments to the structure of the hand gripper ring 1.

More specifically, the hand gripper ring 1 comprises a gripper ring body 10 having a central cavity 101. The gripper ring body 10 comprises at least two grip portion groups each comprising two gripping portions symmetrical to a center 102 of the gripper ring body 10, the two grip portion groups have different elastic properties, so that the user needs to provide different gripping forces when holding different relative grip portions of the gripper ring body 10 for exercising. When the user needs to adjust the intensity of exercise, he or she just need to hold different grip portion groups.

Correspondingly, in this embodiment of the present invention, one of the at least two grip portion groups is defined as a first grip portion group 11, and the other of the two grip portion groups is defined as a second grip portion group 12.

The two gripping parts of the first grip portion group 11 are respectively defined as a first gripping portion 111 and a second gripping portion 112. The two gripping parts of the second grip portion group 12 are respectively defined as a third gripping portion 121 and a fourth gripping portion 122. The first gripping portion 111 and the second gripping portion 112 are arranged in a first direction D1 shown in FIG. 1 and facing toward each other. In a preferred embodiment of the present invention, the first gripping portion 111 and the second gripping portion 112 are on two opposite sides of the center 102 of the gripper ring body 10. The third gripping portion 121 and the fourth gripping portion 122 are arranged in a second direction D2 shown in FIG. 1 and are on two opposite sides of the center 102 of the gripper ring body 10.

In the present invention, the midpoint of the line between the geometric center of the first gripping portion 111 and the geometric center of the second gripping portion 112 is defined as the center 102 of the hand gripper ring 1. Correspondingly, the midpoint of the line between the geometric center of the third gripping portion 121 and the geometric center of the fourth gripping portion 122 is the same center 102 of the hand gripper ring 1.

The first gripping portion 111 and the second gripping portion 112 may be symmetrical or asymmetrical on two sides of the center 102 of the gripper ring body 10. The third gripping portion 121 and the fourth gripping portion 122 may be symmetrical or asymmetrical on two sides of the center 102 of the gripper ring body 10. Preferably, in this embodiment, The first gripping portion 111 and the second gripping portion 112 are symmetrical to each other, the third gripping portion 121 and the fourth gripping portion 122 are also symmetrical to each other.

The distance between the first gripping portion 111 and the center 102 of the gripper ring body 10 may be the same as or different from the distance between the third gripping portion 121 and the center 102 of the gripper ring body 10. The distance between the second gripping portion 112 and the center 102 of the gripper ring body 10 may be the same as or different from the distance between the fourth gripping portion 122 and the center 102 of the gripper ring body 10.

There is an angle between the first direction D1 and the second direction D2, and the angle between the first direction D1 and the second direction D2 is not equal to 0 degrees or 180 degrees. In one example of the present invention, the first direction D1 and the second direction D2 are perpendicular to each other. In another example of the present invention, the angle between the first direction D1 and the second direction D2 may not equal to 90 degrees.

More specifically, the different elastic properties of at least two grip portion groups can be achieved through a variety of approaches, such as different cross-sectional areas, different materials, different densities, etc.

Accordingly, in one embodiment of the present invention, a size of the cross section of the first grip portion group 11 is different from a size of the cross section of the second grip portion group 12, so that the elastic properties of the first grip portion group 11 and the second grip portion group 12 are different.

For example, in one example of the present invention, the size of the cross section of the first grip portion 111 is larger than the size of the cross section of the third grip portion 121, and/or the size of the cross section of the second grip portion 112 is larger than the size of the cross section of the fourth grip portion 122; in one example of the present invention, the size of the cross section of the first grip portion 111 is smaller than the size of the cross section of the third grip portion 121, and/or the size of the cross section of the second grip portion 112 is smaller than the size of the cross section of the fourth grip portion 122.

Figure 2:
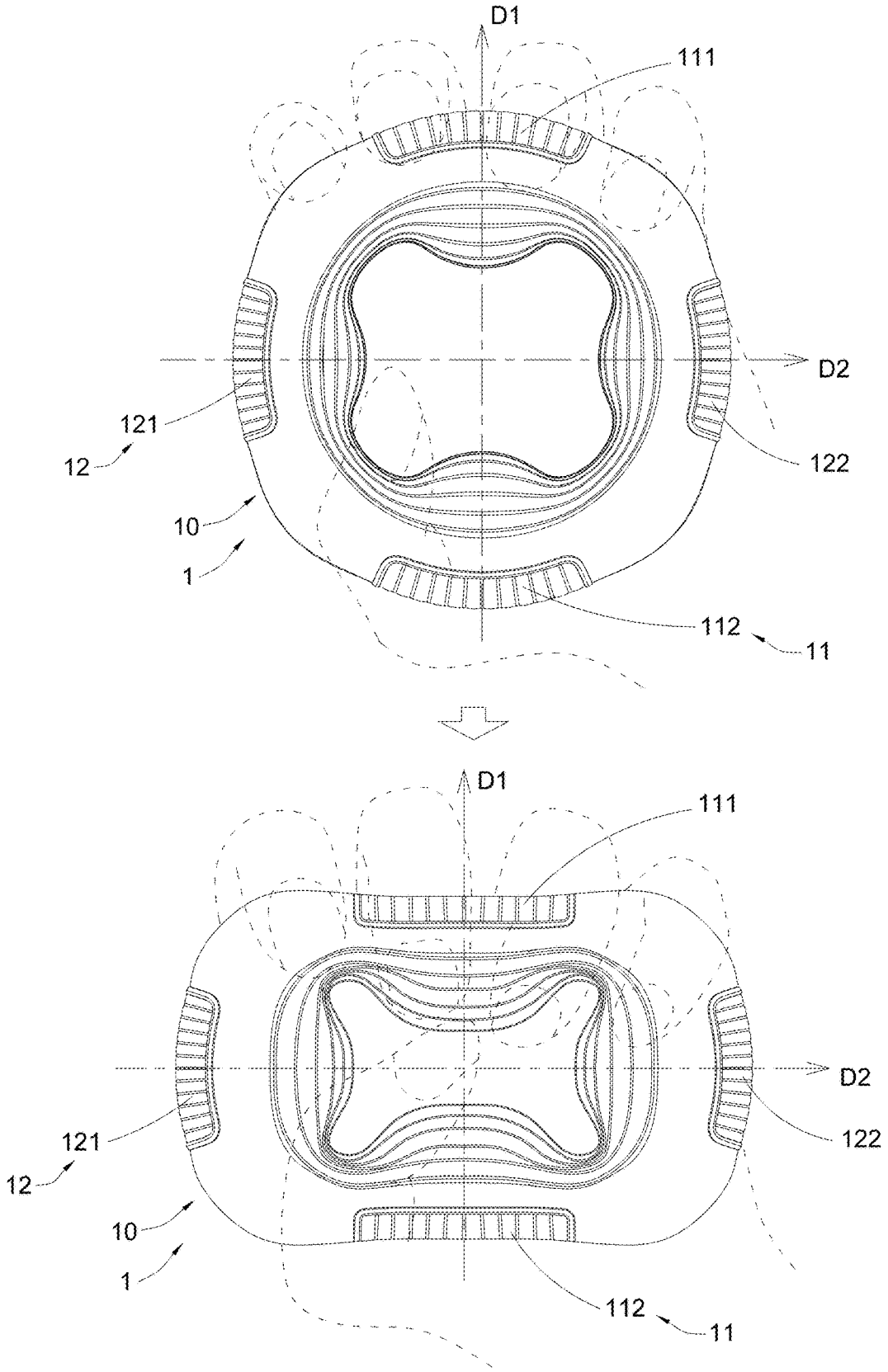
FIG. 2 is a schematic view showing the hang gripper ring being gripped along a first direction according to the above first embodiment of the present invention.
Figure 3:
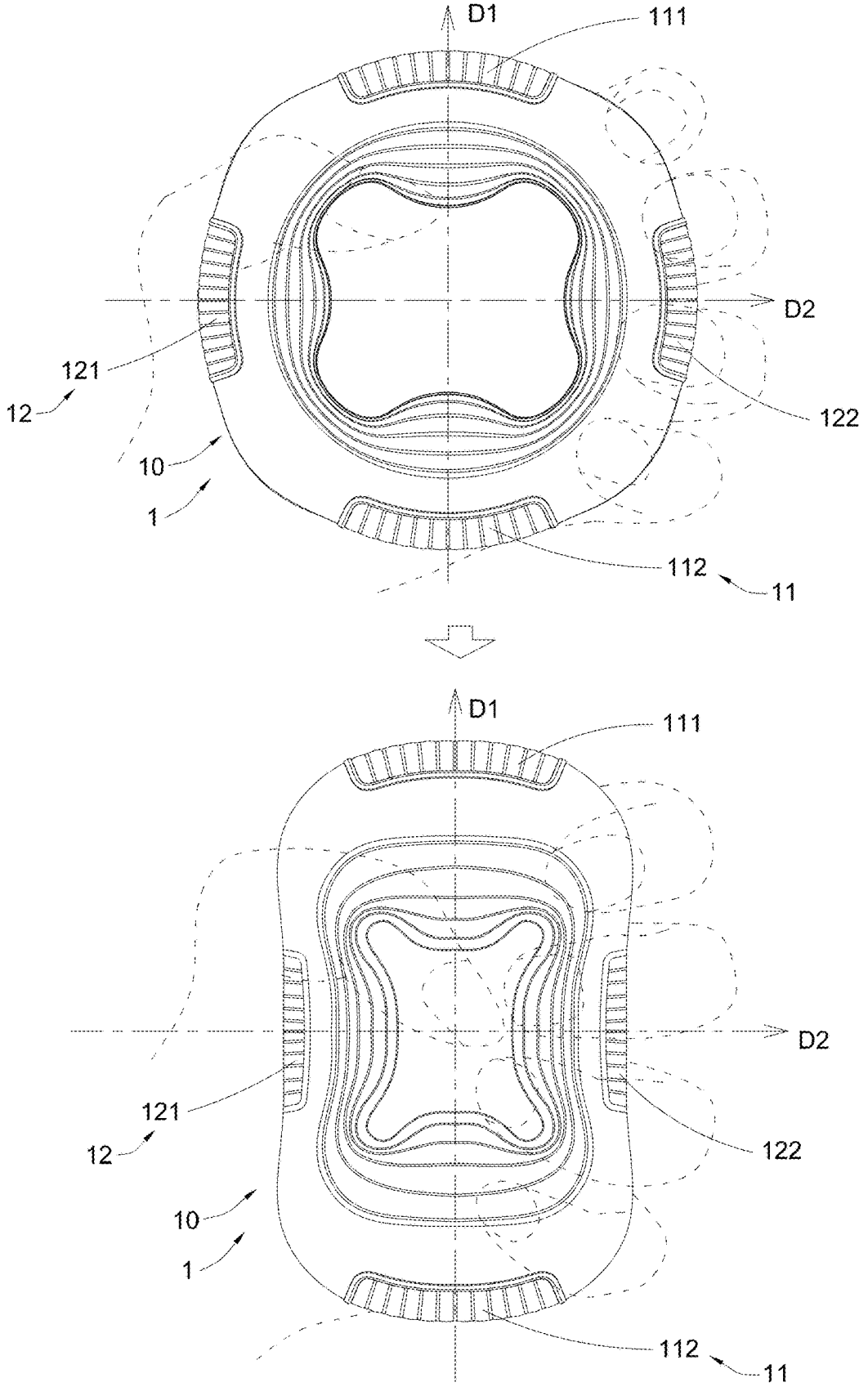
FIG. 3 is a schematic view showing the hang gripper ring being gripped along a second direction according to the above first embodiment of the present invention.

When the gripper ring body 10 is gripped, the gripping portions being gripped moves toward the central cavity 101, and the gripping portions not being gripped prevents the gripping portion being gripped from moving toward the central cavity 101. For example, when the first grip portion group 11 of the gripper ring body 10 is gripped, the first gripping portion 111 and the second gripping portion 112 of the first grip portion group 11 move toward the center 102 of the gripper ring body 10, as shown in FIG. 2; the third gripping portion 121 and the fourth gripping portion 122 of the second gripping portion 12 prevent the first gripping portion 111 and the second gripping portion 112 of the first grip portion group 11 from moving toward the center 102 of the gripper ring body 10. When the second grip portion group 12 of the gripper ring body 10 is gripped, the third gripping portion 121 and the fourth gripping portion 122 of the second gripping portion 12 move closer to the center 102 of the gripper ring body 10, as shown in FIG. 3; the first gripping portion 111 and the second gripping portion 112 of the first grip portion group 11 hinder the third gripping portion 121 and the fourth gripping portion 122 of the second grip portion group 12 from moving closer to the center 102 of the gripper ring body 10.

When the cross-sectional dimension of the first gripping portion 111 of the first grip portion group 11 is greater than the cross-sectional dimension of the third gripping portion 121 of the second gripping portion 12, and/or the cross-sectional dimension of the second gripping portion 112 of the first grip portion group 11 is greater than the cross-sectional dimension of the fourth gripping portion 122 of the second gripping portion 12, the resistance of the second grip portion group 12 applied to the first grip portion group 11 when the first gripping portion 111 and the second gripping portion 112 of first grip portion group 11 are pressed by the fingers of the user to move close to each other toward the center 102 of the gripper ring body 10 is less than the resistance of the first grip portion group 11 applied to the second grip portion group 12 when the third gripping portion 121 and the fourth gripping portion 122 of the second grip portion group 12 are pressed by the fingers of the user to move close to each other toward center 102 of the gripper ring body 10, so that the rated force value of the hand gripper ring 1 in the first direction D1 is less than the rated force value of the hand gripper ring 1 in the second direction D2. In one example of the present invention, the rated force value of the hand gripper ring 1 in the first direction D1 is 50 pounds, and the rated force value of the gripper in the second direction D2 is 60 pounds. Correspondingly, the maximum force required by the user when holding the first grip portion group 11 for exercise along the first direction D1 is smaller than the maximum force required by the user when holding the second grip portion group 12 for excise along the second direction D2.

When the cross-sectional dimension of the first gripping portion 111 is smaller than the cross-sectional dimension of the third gripping portion 121, and/or the cross-sectional dimension of the second gripping portion 112 is smaller than the cross-sectional dimension of the fourth gripping portion 122, the resistance of the second grip portion group 12 applied to the first grip portion group 11 when the first gripping portion 111 and the second gripping portion 112 of the first grip portion group 11 move toward each other is greater than the resistance of the first grip portion group 11 to the second grip portion group 12 when the third gripping portion 121 and the fourth gripping portion 122 of the second grip portion group 12 move toward each other, so that the rated force value of the hand gripper ring 1 in the first direction D1 is greater than the rated force value of the hand gripper ring 1 in the second direction D2. Accordingly, the maximum force required by the user to hold the first grip portion group 11 for excise along the first direction D1 is greater than the maximum force required by the user to hold the second grip portion group 12 for exercise along the second direction D2.

In another embodiment of the present invention, the material of the first grip portion group 11 is different from the material of the second grip portion group 12, so that the elastic properties of the first grip portion group 11 and the second grip portion group 12 are different.

In one example of the present invention, the elastic modulus of the material of the first grip portion 111 is greater than the elastic modulus of the third grip portion 121, and/or the elastic modulus of the second grip portion 112 is greater than the elastic modulus of the fourth grip portion 122. In one example of the present invention, the elastic modulus of the first grip portion 111 is less than the elastic modulus of the third grip portion 121, and/or the elastic modulus of the second grip portion 112 is less than the elastic modulus of the fourth grip portion 122.

In another embodiment of the present invention, the density of the first grip portion group 11 is different from the density of the second grip portion group 12, so that the elastic properties of the first grip portion group 11 and the second grip portion group 12 are different.

In one example of the present invention, the density of the material of the first grip portion 111 is greater than the density of the third grip portion 121, and/or the density of the second grip portion 112 is greater than the density of the fourth grip portion 122. In one example of the present invention, the density of the first grip portion 111 is less than the density of the third grip portion 121, and/or the density of the second grip portion 112 is less than the density of the fourth grip portion 122.

In some embodiments of the present invention, the number of the grip portion groups is greater than two. Accordingly, in one embodiment of the present invention, the at least two grip portion groups comprises a third grip portion group 13 and a fourth grip portion group 14. The elastic properties of the first grip portion group 11, the second grip portion group 12, the third grip portion group 13, and the fourth grip portion group 14 are different.

The two gripping parts of the third grip portion group 13 are respectively defined as a fifth gripping portion 131 and a sixth gripping portion 132. The two gripping parts of the fourth grip portion group 14 are respectively defined as a seventh gripping portion 141 and an eighth gripping portion 142. The fifth gripping portion 131 and the sixth gripping portion 132 are arranged in the third direction D3 and are at two opposite sides of the center 102 of the gripper ring body 10. The seventh gripping portion 141 and the eighth gripping portion 142 are arranged in the fourth direction D4 and are at two opposite sides of the center 102 of the gripper ring body 10.

Alternatively, the fifth gripping portion 131 and the sixth gripping portion 132 may be symmetrical with respect to the center 102 of the gripper ring body 10, or may not be symmetrical with respect to the center 102 of the gripper ring body 10. Alternatively, the seventh gripping portion 141 and the eighth gripping portion 142 may be symmetrical with respect to the center 102 of the gripper ring body 10, or may not be symmetrical with respect to the center 102 of the gripper ring body 10.

The distance between the fifth gripping portion 131 and the center 102 of the gripper ring body 10 may be the same as or different from the distance between the first gripping portion 111 and the center 102 of the gripper ring body 10. The distance between the sixth gripping portion 132 and the center 102 of the gripper ring body 10 may be the same as or different from the distance between the second gripping portion 112 and the center 102 of the gripper ring body 10. The distance between the seventh gripping portion 141 and the center 102 of the gripper ring body 10 may be the same as or different from the distance between the first gripping portion 111 and the center 102 of the gripper ring body 10. The distance between the eighth gripping portion 142 and the center 102 of the gripper ring body 10 may be the same as or different from the distance between the second gripping portion 112 and the center 102 of the gripper ring body 10.

The angle between the third direction D3 and the first direction D1 is not equal to 0 degrees or 180 degrees. There is an angle between the third direction D3 and the second direction D2, and the angle between the third direction D3 and the second direction D2 is not equal to 0 degrees or 180 degrees. In one example of the present invention, the angle between the third direction D3 and the first direction D1 is equal to 45 degrees. In another example of the present invention, the angle between the third direction D3 and the first direction D1 is other values, that is, values other than 90 degrees and 45.

The angle between the fourth direction D4 and the first direction D1 is not equal to 0 degrees or 180 degrees. There is an angle between the fourth direction D4 and the second direction D2, and the angle between the fourth direction D4 and the second direction D2 is not equal to 0 degrees or 180 degrees. In one example of the present invention, the angle between the fourth direction D4 and the first direction D1 is equal to 45 degrees. In another example of the present invention, the angle between the fourth direction D4 and the first direction D1 is other values, that is, values other than 90 degrees and 45.

More specifically, the elastic properties of the third grip portion group 13 and other relative gripping portions can be different through various approaches, such as different cross-sectional areas, different materials, different densities, etc.

Correspondingly, in one embodiment of the present invention, the size of the cross section of the third grip portion group 13 is different from the size of the cross section of the first grip portion group 11, so that the elastic properties of the third grip portion group 13 and the first grip portion group 11 are different. The size of the cross section of the third grip portion group 13 is different from the size of the cross section of the second grip portion group 12, so that the elastic properties of the third grip portion group 13 and the second grip portion group 12 are different. The size of the cross section of the third grip portion group 13 is different from the size of the cross section of the fourth grip portion group 14, so that the elastic properties of the third grip portion group 13 and the fourth grip portion group 14 are different.

The size of the cross section of the fourth grip portion group 14 is different from the size of the cross section of the first grip portion group 11, so that the elastic properties of the fourth grip portion group 14 are different from those of the first grip portion group 11. The size of the cross section of the fourth grip portion group 14 is different from the size of the cross section of the second grip portion group 12, so that the elastic properties of the fourth grip portion group 14 are different from those of the second grip portion group 12.

For example, in one example of the present invention, the size of the cross section of the fifth grip portion 131 is greater than the size of the cross section of the first grip portion 111, and/or the size of the cross section of the sixth grip portion 132 is greater than the size of the cross section of the second grip portion 112;

In one example of the present invention, the size of the cross section of the fifth grip portion 131 is smaller than the size of the cross section of the first grip portion 111, and/or the size of the cross section of the sixth grip portion 132 is smaller than the size of the cross section of the second grip portion 112. The size of the cross section of the seventh grip portion 141 is larger than the size of the cross section of the first grip portion 111, and/or the size of the cross section of the eighth grip portion 142 is larger than the size of the cross section of the second grip portion 112.

In another embodiment of the present invention, the material of the third grip portion group 13 is different from the material of the first grip portion group 11, so that the elastic properties of the third grip portion group 13 and the first grip portion group 11 are different. The material of the third grip portion group 13 is different from the material of the second grip portion group 12, so that the elastic properties of the third grip portion group 13 and the second grip portion group 12 are different. The material of the third grip portion group 13 is different from the material of the fourth grip portion group 14, so that the elastic properties of the third grip portion group 13 and the fourth grip portion group 14 are different.

The material of the fourth grip portion group 14 is different from the material of the first grip portion group 11, so that the elastic properties of the fourth grip portion group 14 and the first grip portion group 11 are different. The material of the fourth grip portion group 14 is different from the material of the second grip portion group 12, so that the elastic properties of the fourth grip portion group 14 and the second grip portion group 12 are different.

In one example of the present invention, the elastic modulus of the material of the fifth grip portion 131 is greater than the elastic modulus of the first grip portion 111, and/or the elastic modulus of the sixth grip portion 132 is greater than the elastic modulus of the first grip portion 111. The elastic modulus of the material of the seventh grip portion 141 is greater than the elastic modulus of the first grip portion 111, and/or the elastic modulus of the eighth grip portion 142 is greater than the elastic modulus of the first grip portion 111. In one example of the present invention, the elastic modulus of the fifth grip portion 131 is less than the elastic modulus of the first grip portion 111, and/or the elastic modulus of the sixth grip portion 132 is less than the elastic modulus of the first grip portion 111. The elastic modulus of the seventh grip portion 141 is less than the elastic modulus of the first grip portion 111, and/or the elastic modulus of the eighth grip portion 142 is less than the elastic modulus of the first grip portion 111.

In another embodiment of the present invention, the density of the third grip portion group 13 is different from the density of the first grip portion group 11, so that the elastic properties of the third grip portion group 13 and the first grip portion group 11 are different. The density of the third grip portion group 13 is different from the density of the second grip portion group 12, so that the elastic properties of the third grip portion group 13 and the second grip portion group 12 are different. The density of the third grip portion group 13 is different from the density of the fourth grip portion group 14, so that the elastic properties of the third grip portion group 13 and the fourth grip portion group 14 are different.

The density of the fourth grip portion group 14 is different from that of the first grip portion group 11, so that the elastic properties of the fourth grip portion group 14 and the first grip portion group 11 are different. The density of the fourth grip portion group 14 is different from that of the second grip portion group 12, so that the elastic properties of the fourth grip portion group 14 and the second grip portion group 12 are different.

In one example of the present invention, the density of the material of the fifth grip portion 131 is greater than the density of the first grip portion 111, and/or the density of the sixth grip portion 132 is greater than the density of the first grip portion 111. The density of the material of the seventh grip portion 141 is greater than the density of the first grip portion 111, and/or the density of the seventh grip portion 141 is greater than the density of the first grip portion 111. In one example of the present invention, the density of the fifth grip portion 131 is less than the density of the first grip portion 111, and/or the density of the sixth grip portion 132 is less than the density of the first grip portion 111. The density of the seventh grip portion 141 is less than the density of the first grip portion 111, and/or the density of the eighth grip portion 142 is less than the density of the first grip portion 111.

The shape of the cross section of the gripper ring body 10 is not limited by the present invention, for example, it can be circular, elliptical, irregular, etc. The gripper ring body 10 has an outer peripheral wall 120, an inner peripheral wall 110, and a transition peripheral wall 130. The shape of the outer peripheral wall 120 of the gripper ring body 10 can be the same as the shape of the inner peripheral wall 110 of the gripper ring body 10, or it can be different from the shape of the inner peripheral wall 110 of the gripper ring body 10. The inner peripheral wall 110 of the gripper ring body 10 refers to the peripheral wall of the gripper ring body 10 facing the central cavity 101, and the outer peripheral wall 120 of the gripper ring body 10 is opposite to the inner peripheral wall 110 of the gripper ring body 10 in the radial direction of the gripper ring body 10. The transition peripheral wall 130 of the gripper ring body 10 extends between the inner peripheral wall 110 of the gripper ring body 10 and the outer peripheral wall 120 of the gripper ring body 10.

Correspondingly, each of the gripping portions has an outer peripheral wall 120, an inner peripheral wall 110, and a transitional peripheral wall 130. The shape of the outer peripheral wall 120 of the gripping portion may be the same as or different from the shape of the inner peripheral wall 110 of the gripping portion. The inner peripheral wall 110 of the gripping portion refers to the peripheral wall of the gripping portion facing the central cavity 101, and the outer peripheral wall 120 of the gripping portion is opposite to the inner peripheral wall 110 of the gripping portion in the radial direction of the gripper ring body 10. The transitional peripheral wall 130 of the gripping portion extends between the inner peripheral wall 110 of the gripping portion and the outer peripheral wall 120 of the gripping portion.

The inner circumferential walls 110 of all the gripping parts are enclosed to form the inner circumferential wall 110 of the gripper ring body 10; the outer circumferential walls 120 of all the gripping parts are enclosed to form the outer circumferential wall 120 of the gripper ring body 10; and the transition circumferential walls 130 of all the gripping parts are enclosed to form the transition circumferential wall 130 of the gripper ring body 10.

It is worth mentioning that when the gripper ring body 10 is gripped, the gripping portion being gripped moves closer to the center 102 the inner peripheral walls 110 of the gripping portion not being gripped are squeezed against each other, and the outer peripheral walls 120 of the gripping portion not being gripped are stretched. If the inner peripheral wall 110 of the gripping portion not being gripped protrudes toward the center 102, it will hinder the gripping portion being gripped from moving closer to the central cavity 101. Based on this, the present invention proposes that a space 103 can be formed on the inner peripheral wall 110 of the gripping portion to interrupt the continuous surface of the inner peripheral wall 110 of the gripping portion, thereby reducing the resistance of the gripping portion not gripped to the gripping portion when the gripping portion is gripped closer to the central cavity 101; the protruding direction of the gripping portion can also be shifted, for example, to the side where the transition peripheral wall 130 is located.

Figure 4:
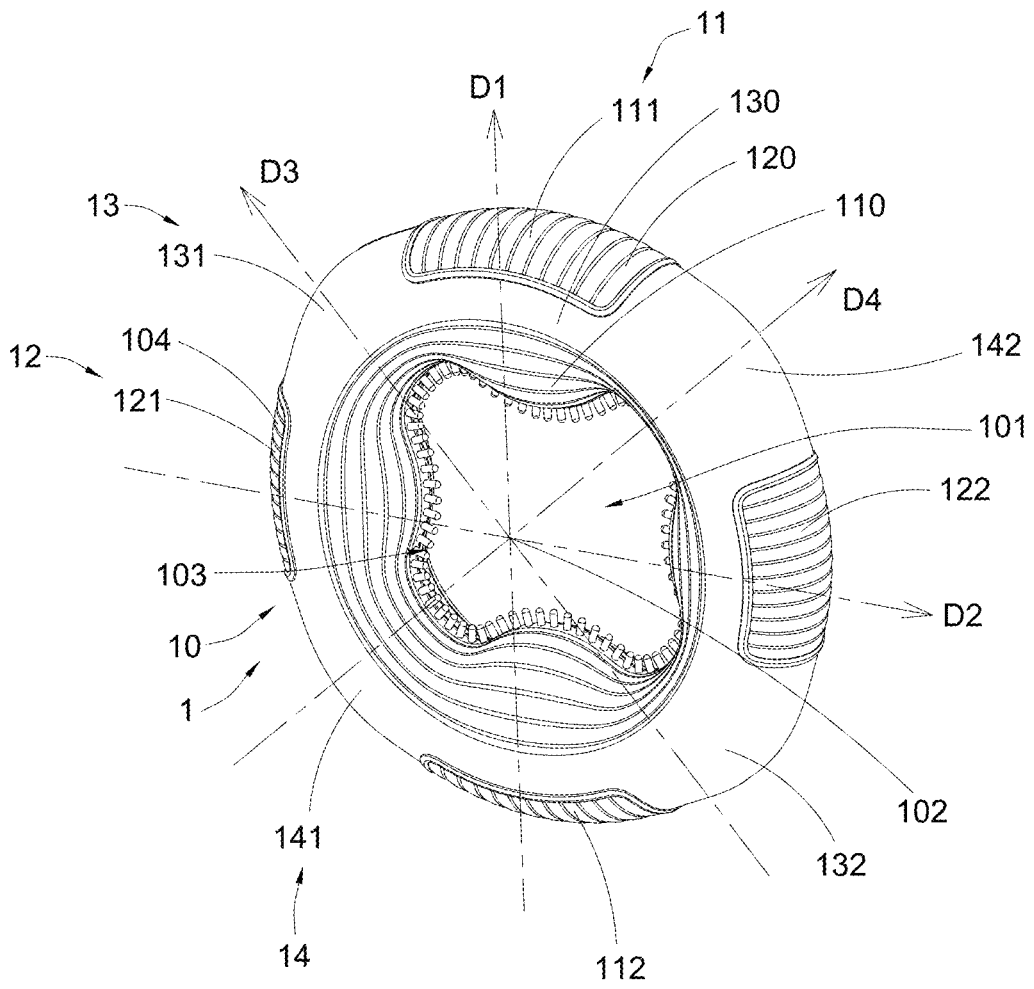
FIG. 4 is a perspective view of a hand gripper ring according to an alternative mode of the above first embodiment of the present invention.
Figure 5:
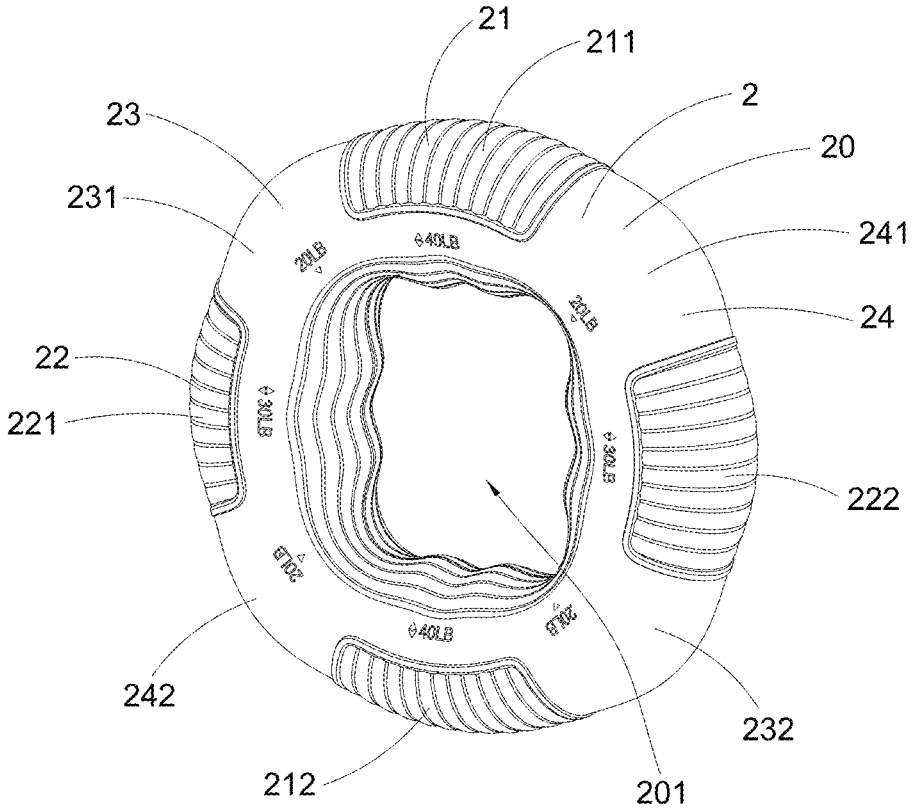
FIG. 5 is a perspective view of a hand gripper ring according to a second embodiment of the present invention.
Figure 6A:
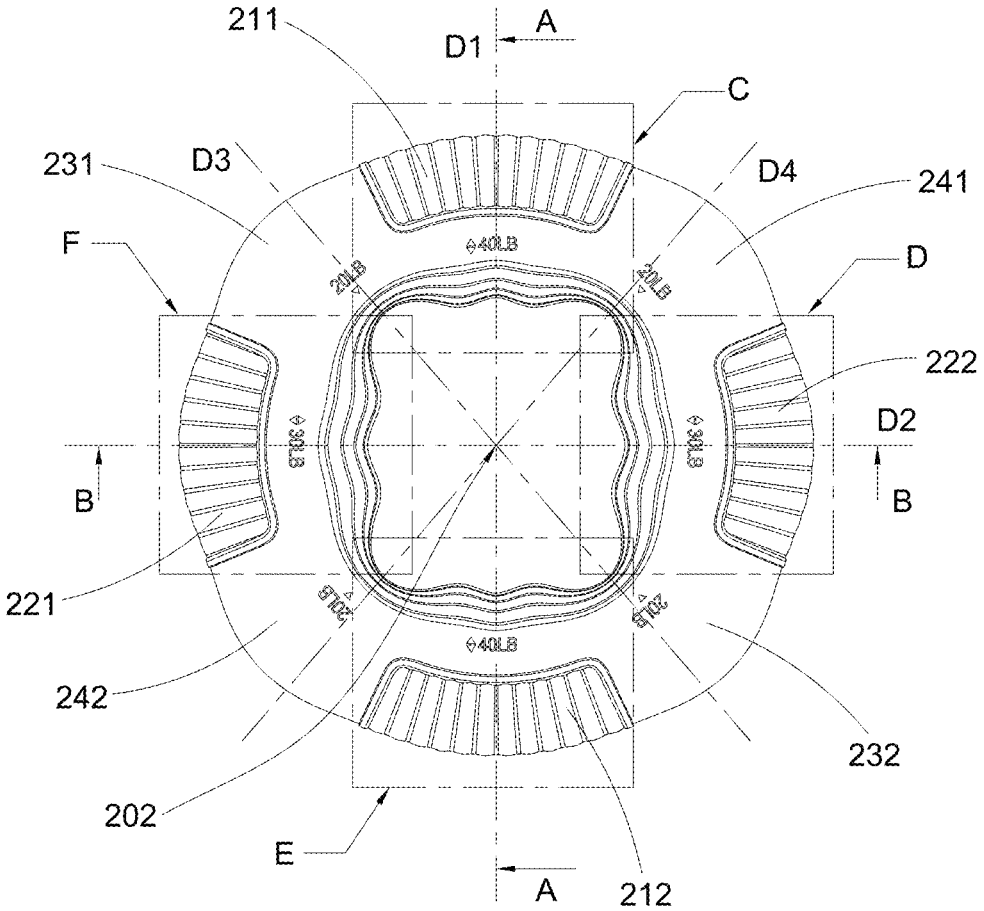
FIG. 6A is a schematic view of the hand gripper ring according to the above second embodiment of the present invention.
Figure 6B:
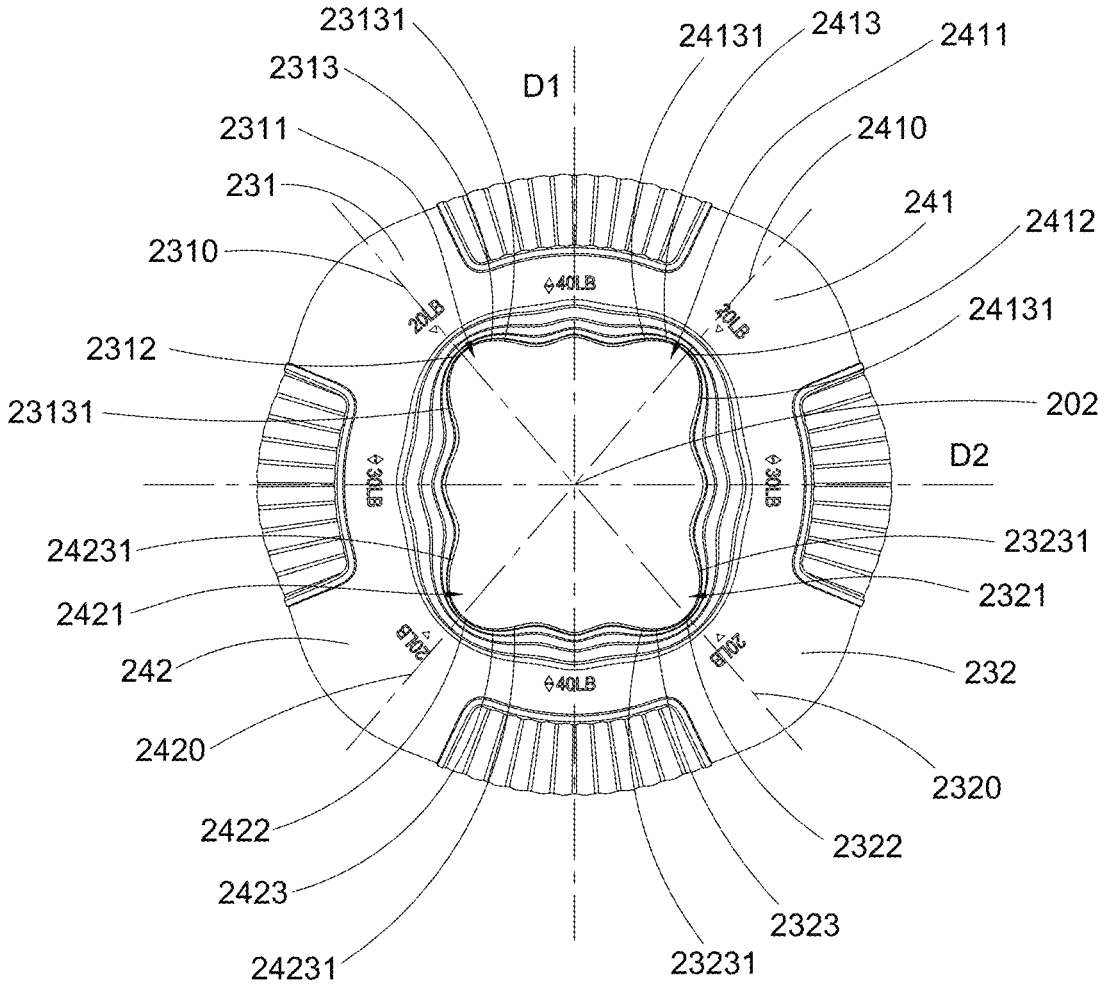
FIG. 6B is another schematic view of the hand gripper ring according to the above second embodiment of the present invention.
Figure 7:
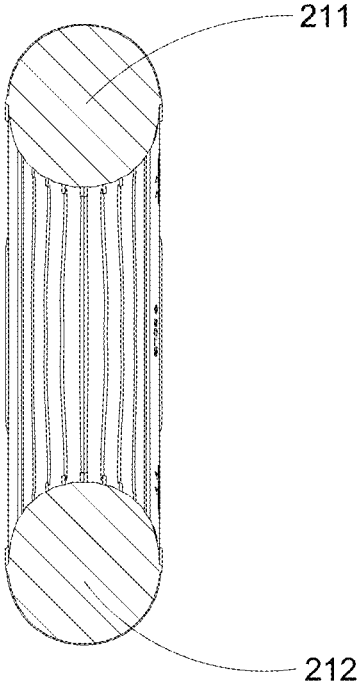
FIG. 7 is a sectional view along line A-A of FIG. 6A.
Figure 8:
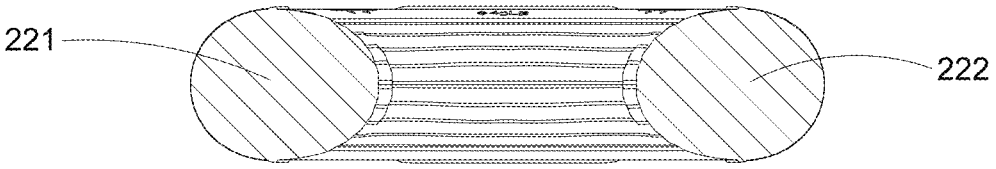
FIG. 8 is a sectional view along line B-B of FIG. 6A.
Figure 9:
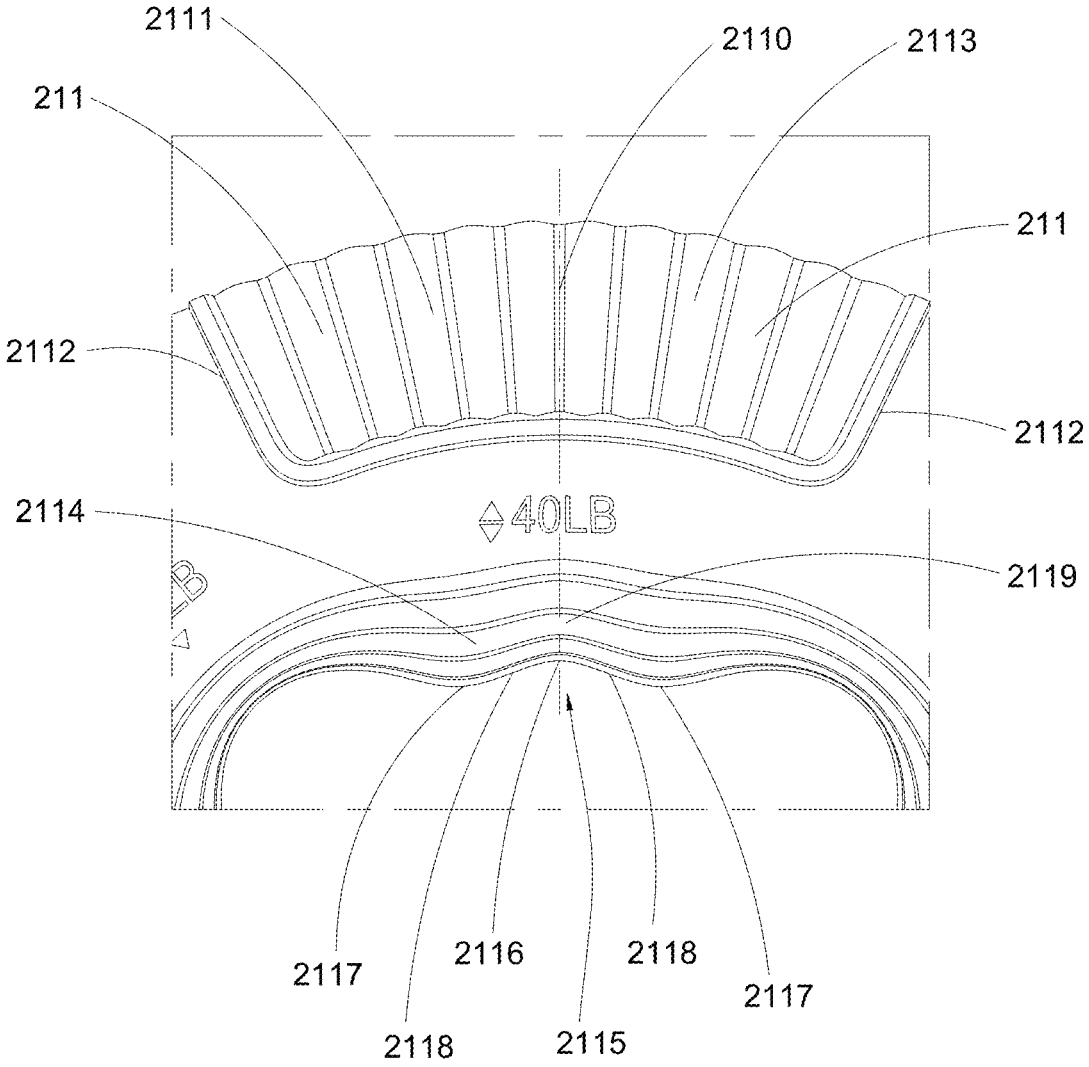
FIG. 9 is an partial enlarged view of area C of FIG. 6A.
Figure 10:
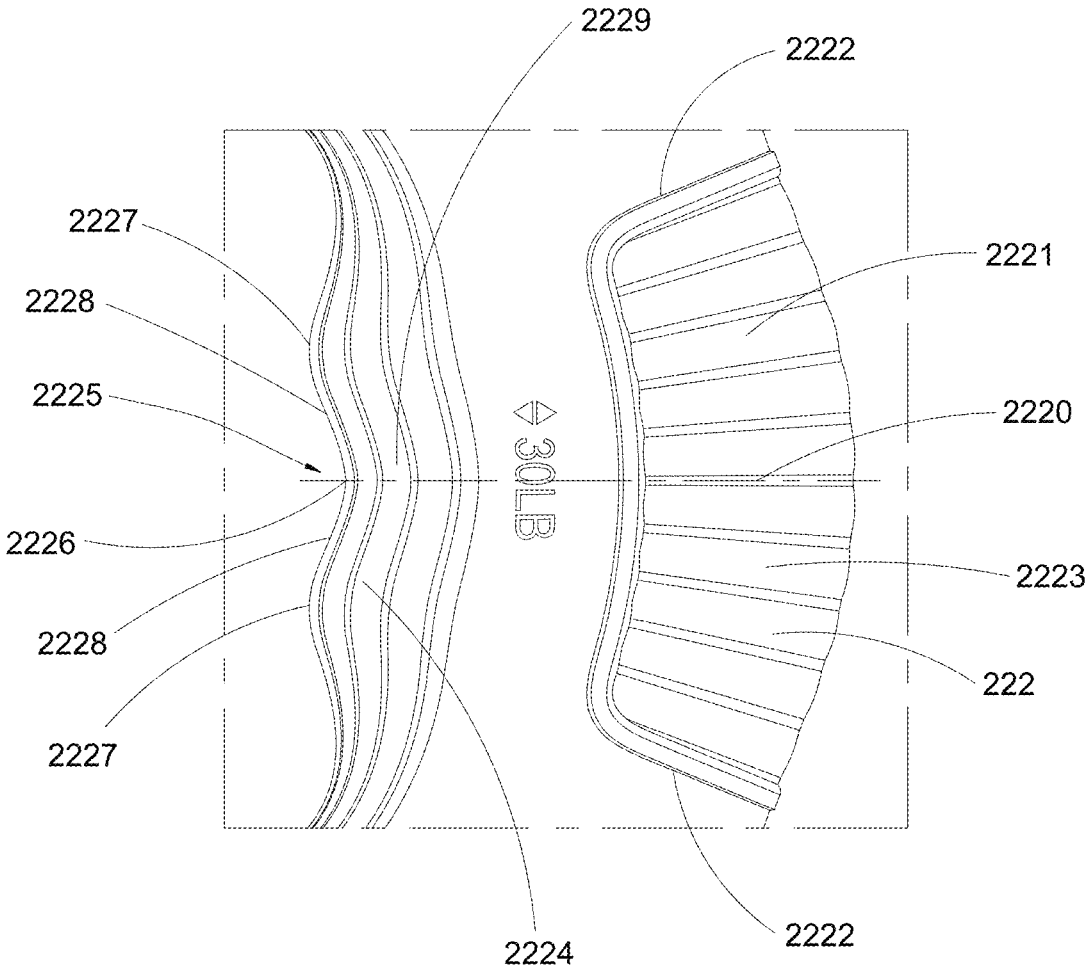
FIG. 10 is an partial enlarged view of area D of FIG. 6A.
Figure 11:
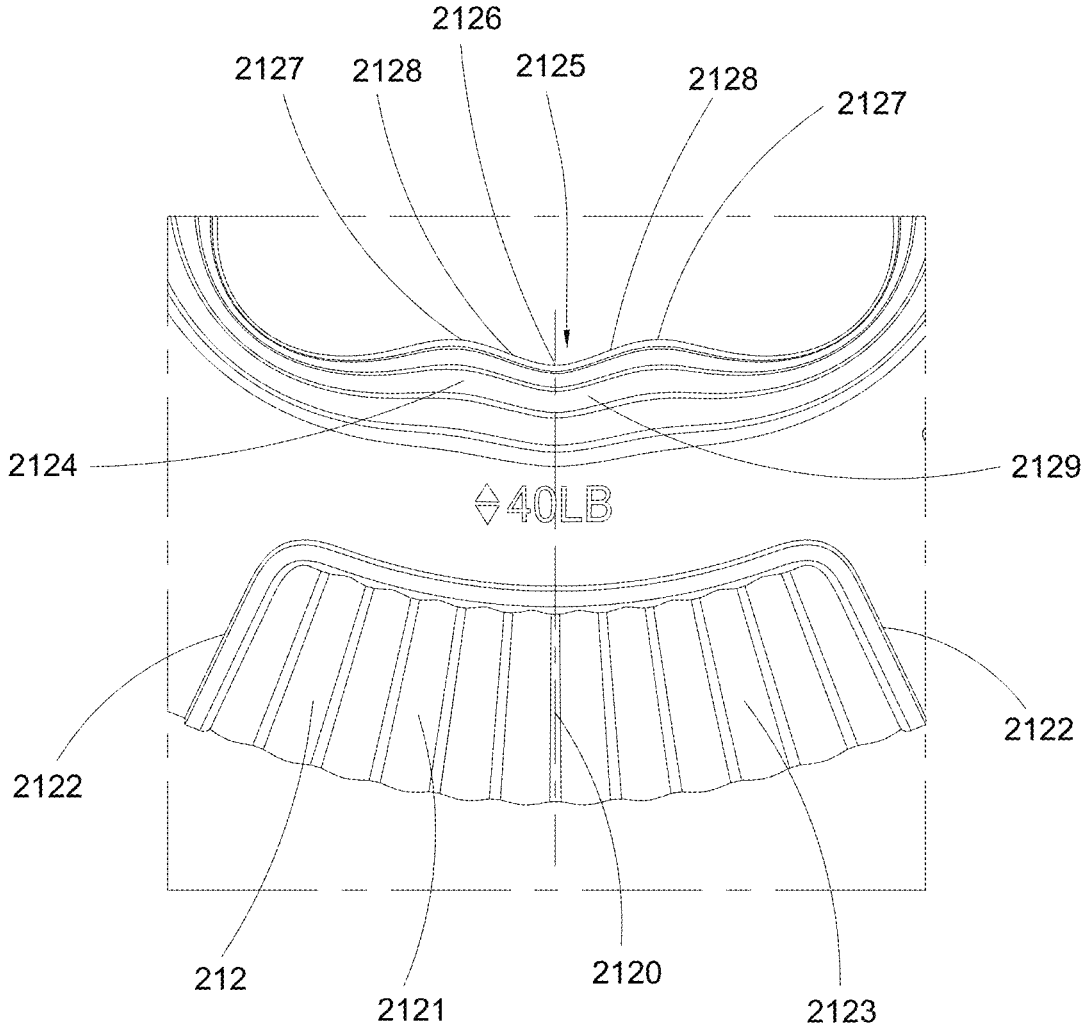
FIG. 11 is an partial enlarged view of area E of FIG. 6A.
Figure 12:
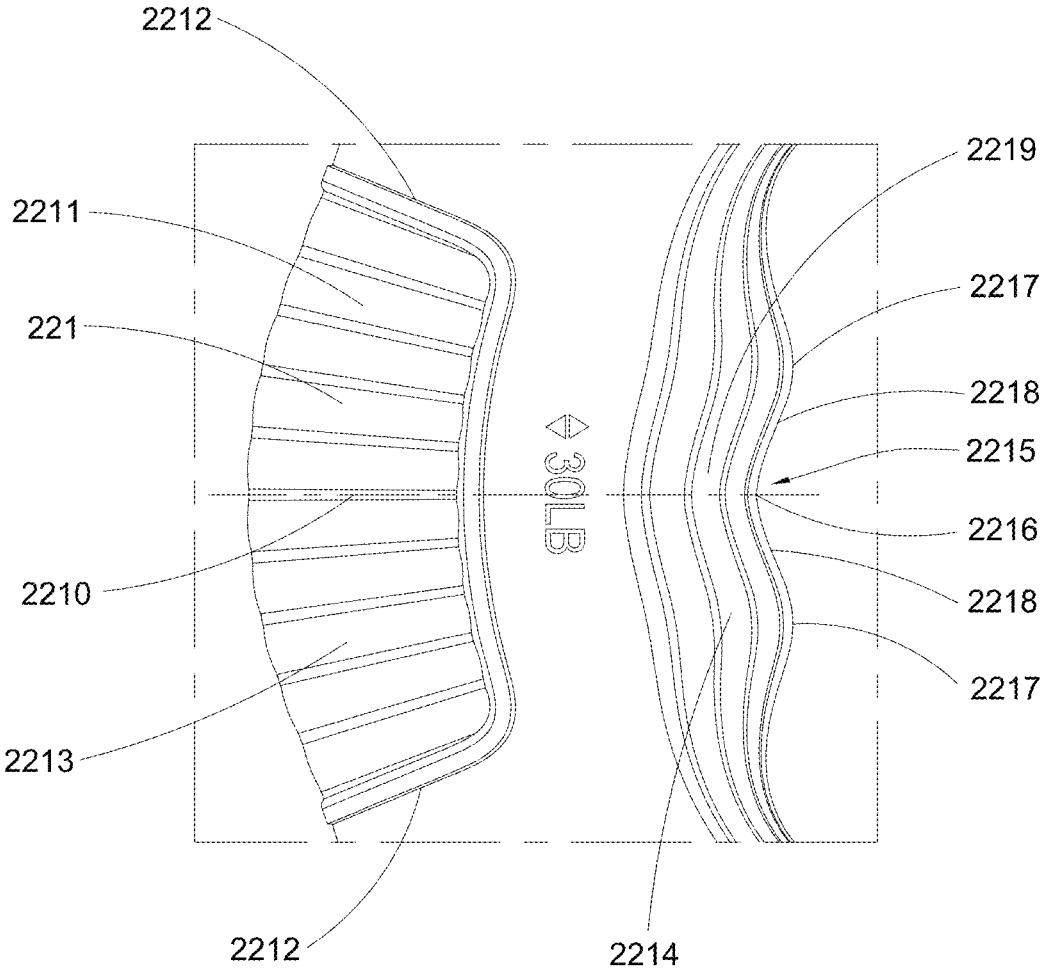
FIG. 12 is an partial enlarged view of area F of FIG. 6A.

Correspondingly, in one embodiment of the present invention, at least one inner peripheral wall 110 of the gripping portion is partially recessed outward to form at least one space 103, as shown in FIG. 4.

In another embodiment of the present invention, the inner peripheral wall 110 of at least one of the gripping portions is recessed outward, and the curvature of at least a portion of the transition peripheral wall 130 thereof is greater than a preset value.

In one embodiment of the present invention, the gripper ring body 10 further has at least one anti-slip portion 104, and the anti-slip portion 104 protrudes from the outer surface of the corresponding gripping portion 11 to play an anti-slip role.

It is worth mentioning that the gripper ring body 10 is elastic as a whole and easy to hold, so that the user can exercise grip strength directly by holding the gripper ring body 10; that is, the gripper ring body 10 is not only the elastic part of the hand gripper ring 1, but also can serve as the grippable part of the hand gripper ring 1. In this way, the hand gripper ring 1 does not need to be provided with other mechanical structures for connecting or fixing the elastic part and mechanical structures for easy gripping. Accordingly, the hand gripper ring 1 of the present invention has a relatively simple structure, controllable volume, light weight, easy to carry, and low manufacturing difficulty and cost.

Referring to FIGS. 5 to 15*c* of the drawings, a hand gripper ring 2 according to a second embodiment of the present invention is illustrated, the elastic properties of at least two parts of the hand gripper ring 2 are different, so that the user should provide different gripping forces when holding different positions. In this way, when the user needs to adjust the intensity of the exercise, he or she only needs to change the gripping position, without having to replace a new hand gripper ring 2 or make cumbersome adjustments to the structure of the hand gripper ring 2.

More specifically, the hand gripper ring 2 comprises a gripper ring body 20 having a central cavity 201. The gripper ring body 20 comprises at least two grip portion groups each comprising two gripping portions symmetrical to a center 202 of the gripper ring body 20, the at least two grip portion groups are connected along a circumferental direction to form the gripper ring body 20 and have different elastic properties, so that the user needs to provide different gripping forces when holding different relative grip portions of the gripper ring body 20 for exercising. When the user needs to adjust the intensity of exercise, he or she just need to hold different grip portion groups.

Correspondingly, in this embodiment of the present invention, the at least two grip portion groups comprise a first grip portion group 21 and a second grip portion group 12, the two grip portion groups are provided along different directions and have different elastic properties.

The two gripping parts of the first grip portion group 21 are respectively defined as a first gripping portion 211 and a second gripping portion 212. The two gripping parts of the second grip portion group 22 are respectively defined as a third gripping portion 221 and a fourth gripping portion 222. The first gripping portion 211 and the second gripping portion 212 are arranged in a first direction D1 shown in FIG. 6A and facing toward each other. In a preferred embodiment of the present invention, the first gripping portion 211 and the second gripping portion 212 are on two opposite sides of the center 202 of the gripper ring body 20. The third gripping portion 221 and the fourth gripping portion 222 are arranged in a second direction D2 shown in FIG. 6A and are on two opposite sides of the center 202 of the gripper ring body 20.

In this embodiment, the first direction D1 is defined as a direction along centerlines of the first gripping portion 211 and the second gripping portion 212. The second direction D2 is defined as a direction along centerlines of the third gripping portion 221 and the fourth gripping portion 222.

More specifically, the first gripping portion 211 has a first centerline 2110 that is extending along a radial direction passing through the center 202 of the gripper ring body 20. The second gripping portion 212 has a second centerline 2120 that is extending along a radial direction passing through the center 202 of the gripper ring body 20. The first centerline 2110 and the second centerline 2120 are along a same line passing through the center 202 of the gripper ring body 20, the first direction D1 is the direction along the first centerline 2110 and the second centerline 2120.

The third gripping portion 221 has a first centerline 2210 that is extending along a radial direction passing through the center 202 of the gripper ring body 20. The second gripping portion 222 has a second centerline 2220 that is extending along a radial direction passing through the center 202 of the gripper ring body 20. The first centerline 2210 and the second centerline 2220 are along a same line passing through the center 202 of the gripper ring body 20, the second direction D2 is the direction along the first centerline 2110 and the second centerline 2120.

There is an angle between the first direction D1 and the second direction D2, and the angle between the first direction D1 and the second direction D2 is not equal to 0 degrees or 180 degrees. As an example of this embodiment, the first direction D1 and the second direction D2 are perpendicular to each other.

In this embodiment, the two adjacent grip portions along the circumferential direction are distinguishable from each other. As shown in the drawings, the first gripping portion 211 has a first gripping body 2111 and two end edges 2112 along the circumferential direction, the second gripping portion 212 has a second gripping body 2121 and two end edges 2122 along the circumferential direction. The first gripping body 2111 between the two end edges 2112 has a first surface pattern 2113 which is different from surface patterns of adjacent gripping portions, so that the first gripping portion 211 is distinguishable and identifiable. The second gripping body 2121 between the two end edges 2122 has a second surface pattern 2123 which is different from surface patterns of adjacent gripping portions, so that the second gripping portion 212 is distinguishable and identifiable. In this embodiment, the first surface pattern 2113 of the first gripping body 2111 can be the same as the second surface pattern 2123 of the second gripping body 2121.

The third gripping portion 221 has a third gripping body 2211 and two end edges 2212 along the circumferential direction, the fourth gripping portion 222 has a fourth gripping body 2221 and two end edges 2222 along the circumferential direction. The third gripping body 2211 between the two end edges 2212 has a third surface pattern 2213 which is different from surface patterns of adjacent gripping portions, so that the third gripping portion 221 is distinguishable and identifiable. The fourth gripping body 2221 between the two end edges 2222 has a fourth surface pattern 2223 which is different from surface patterns of adjacent gripping portions, so that the fourth gripping portion 222 is distinguishable and identifiable. In this embodiment, the third surface pattern 2213 of the third gripping body 2211 can be the same as the fourth surface pattern 2223 of the fourth gripping body 2221.

Accordingly, in one embodiment of the present invention, a size configuration of the cross section of the first grip portion group 11 is different from a size configuration of the cross section of the second grip portion group 12, so that the elastic properties of the first grip portion group 11 and the second grip portion group 12 are different.

The person of ordinarily skilled in the art should understand that the different elastic properties of the at least two grip portion groups can be achieved through a variety of approaches, such as different volumes, different cross-sectional areas, different materials, different densities, etc. As an example, the first gripping body 2111 and the second gripping body 2121 are symmetrical to each other, the third gripping portion 2211 and the fourth gripping body 2221 are symmetrical to each other, each of the the first gripping body 2111 and the second gripping body 2121 has a volume that is smaller than each of the third gripping portion 2211 and the fourth gripping body 2221.

In this embodiment, the first gripping portion 211 comprises a first protruding portion 2114 protruded from an inner side of the first gripping body 2111, the first protruding portion 2114 has a first concave groove 2115 having a first valley position 2116, two first peak positions 2117 and two first transition surfaces 2118 between the first valley position 2116 and the corresponding first peak positions 2117. The first centerline 2110 is passing through the first valley position 2116 which is located a center of the first concave groove 2115. The transition surfaces 2118 can be inclined surfaces or arc surfaces.

Correspondingly, the second gripping portion 212 comprises a second protruding portion 2124 protruded from an inner side of the second gripping body 2121, the second protruding portion 2124 has a second concave groove 2125 having a second valley position 2126, two second peak positions 2127 and two second transition surfaces 2128 between the second valley position 2126 and the corresponding second peak positions 2127. The second centerline 2120 is passing through the second valley position 2126 which is located a center of the second concave groove 2125. The transition surfaces 2128 can be inclined surfaces or arc surfaces.

Figure 14A:
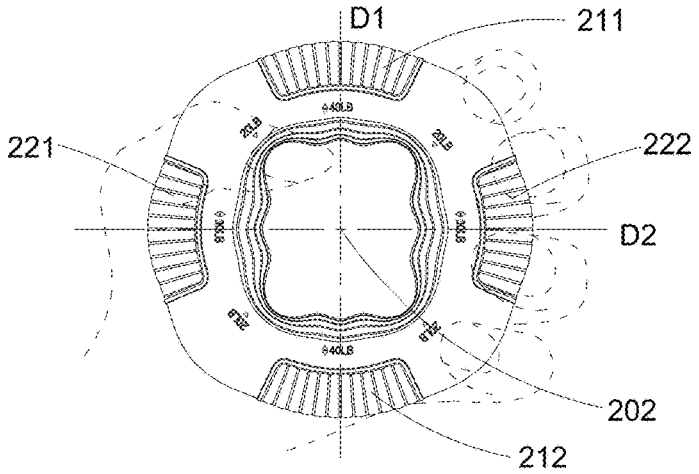
FIGS. 14A, 14B and 14C are schematic views illustrating the hand gripper ring being gripped along a second direction according to the above second embodiment of the present invention.
Figure 14B:
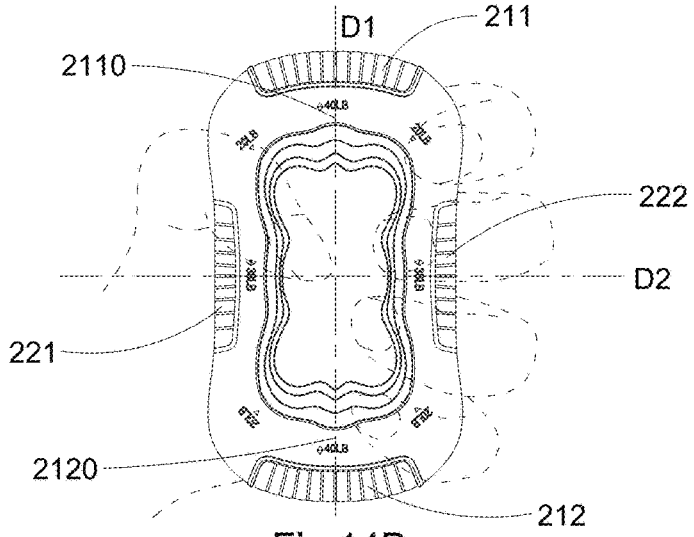
Figure 14C:
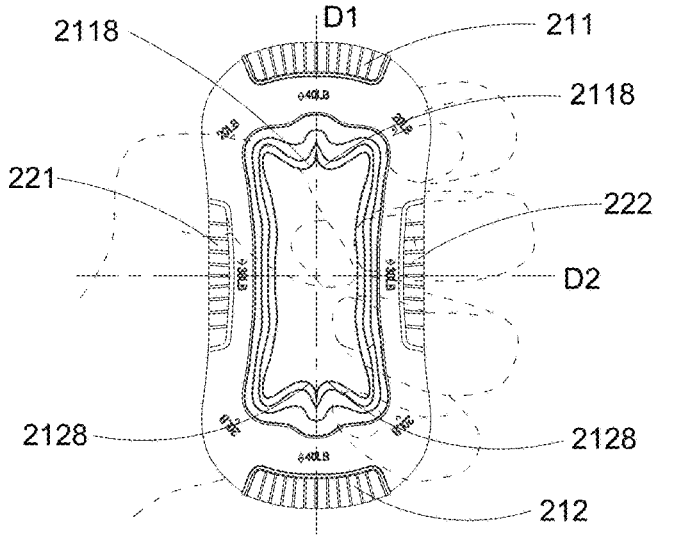

Accordingly, the first gripping portion group 21 has a first group of concave grooves 2115 and 2125 formed at an inner side facing toward the central cavity 201, so that as shown in FIGS. 14A to 14C of the drawings, when the user is holding on the two gripping portions of the second gripping portion group 22 and pressing along the second direction D2 to allow the two gripping portions of the second gripping portion group 22 to move toward each other. The two gripping portions of the first gripping portion group 21 are deformed in a manner that each of the two gripping portions of the first gripping portion group 21 is bending and folding with respect to the first direction D1 along the first centerline 2110 and the second centerline 2120 until the two transition surfaces at the two opposite sides of each centerline are having contact with each other. In other words, the introduction of the first group of concave grooves 2115 and 2125 is able to guide and allow the deformation of the first gripping portion group 21 with respect to the first direction D1.

Accordingly, the first group of the concave grooves 2115 and 2125 in the first gripping portion group 21 are key to controlling how the first gripping portion group 21 deforms when gripping forces are applied to the second gripping portion group 22. The grooves create a predetermined pathway for deformation, which prevents irregular bending and ensures the gripper behaves consistently during use.

When the user grips the second gripping portion group 22 and applies force along the second direction D2, the grooves allow the first gripping portion group 21 to bend symmetrically along its centerlines 2110 and 2120. This symmetry contributes to even resistance during the entire compression cycle, which is crucial for ensuring the exercise remains effective and safe. The smooth, controlled bending helps avoid uneven wear on the device, making it last longer and perform consistently over time.

The concave grooves 2115 and 2125 also serve to distribute the applied force more efficiently across the gripping portions. As the user presses on the two gripping portions of the second gripping group 22, the concave grooves 2115 and 2125 guide the deformation of the first gripping portion group 21. This means that the bending force is not concentrated in one spot but is spread out, reducing the likelihood of damage or structural failure. By spreading the force evenly, the hand gripper ring 2 ensures that no single section of the hand gripper ring is overstressed, which increases the durability of the hand gripper ring 2 and prevents it from breaking down prematurely. Additionally, this even force distribution makes the hand gripper ring 2 more comfortable to use, as it reduces the risk of sharp resistance points that could be uncomfortable or hard to grip.

The introduction of concave grooves 2115 and 2125 allows the first gripping portion group 21 to deform gradually along the first direction D1. This provides the user with a smoother increase in resistance as they press down on the hand gripper ring 2. Rather than encountering sudden or uneven resistance, the bending of the gripping portions happens in a way that feels more natural and progressive.

As a result, users can perform exercises that target their grip strength with a more controlled resistance curve. This is particularly beneficial for rehabilitation or for those with varying levels of grip strength because the resistance can be adjusted by simply changing the force applied, rather than needing to switch to a different device. The gradual and uniform resistance can also reduce the risk of strain or injury during exercise.

Additionally, because the concave grooves 2115 and 2125 guide the deformation along predetermined pathways, they ensure that the user grip remains secure and steady while he or she is applying force. This guided deformation minimizes the chances of the gripper unexpectedly folding in on itself in ways that might cause the user to lose grip, leading to a more safe and controlled exercise.

One potential issue with traditional hand grippers is the risk of over-compression, where the user applies excessive force, causing the gripper to buckle or break. The concave grooves help prevent over-compression by limiting how far the gripping portions can fold inward, as shown in Fig. Of the drawings, the two first transition surfaces 2118 are contacting with each other, and the two second transition surfaces 2128 are contacting with each other to prevent the first gripping portion group 21 to be further deformed.

The inner side of the second gripping group 22 may be not provided with the concave grooves. Preferably, the second gripping group 22 is also provided with the concave groove configuration.

More specifically, the third gripping portion 221 comprises a third protruding portion 2214 protruded from an inner side of the third gripping body 2211, the third protruding portion 2214 has a third concave groove 2215 having a third valley position 2216, two third peak positions 2217 and two third transition surfaces 2218 between the third valley position 2216 and the corresponding third peak positions 2217. The third centerline 2210 is passing through the third valley position 2216 which is located a center of the third concave groove 2215. The transition surfaces 2218 can be inclined surfaces or arc surfaces.

Correspondingly, the fourth gripping portion 222 comprises a fourth protruding portion 2224 protruded from an inner side of the fourth gripping body 2221, the fourth protruding portion 2224 has a fourth concave groove 2225 having a fourth valley position 2226, two fourth peak positions 2227 and two fourth transition surfaces 2228 between the fourth valley position 2226 and the corresponding fourth peak positions 2227. The fourth centerline 2220 is passing through the fourth valley position 2226 which is located a center of the fourth concave groove 2225. The transition surfaces 2228 can be inclined surfaces or arc surfaces.

Figure 13A:
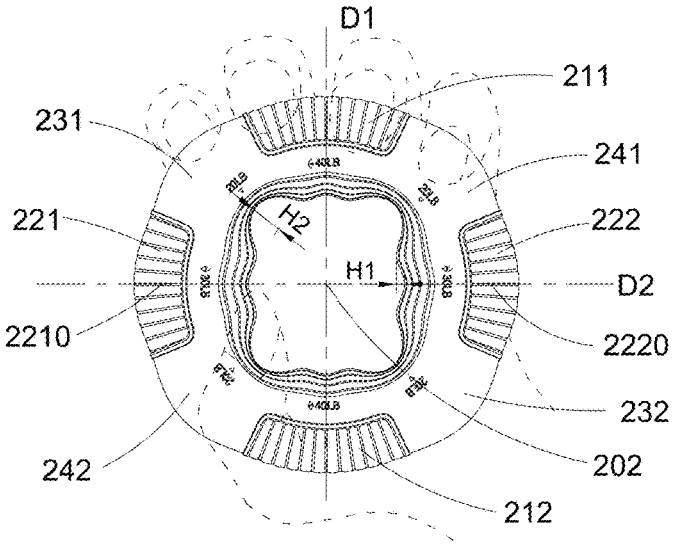
FIGS. 13A, 13B and 13C are schematic views illustrating the hand gripper ring being gripped along a first direction according to the above second embodiment of the present invention.
Figure 13B:
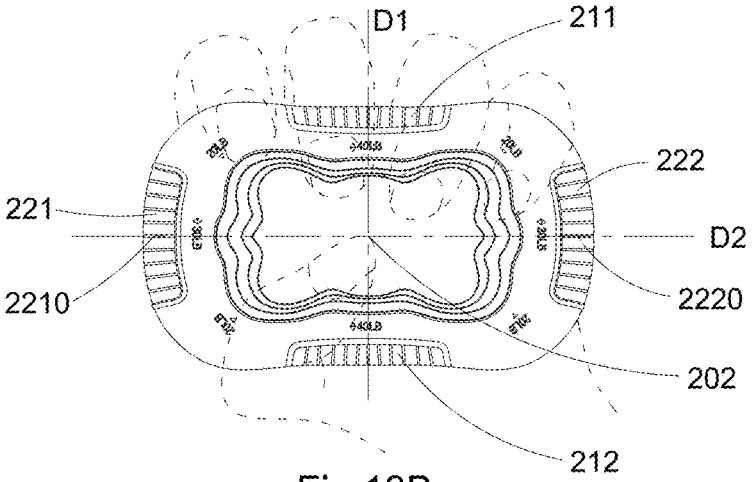
Figure 13C:
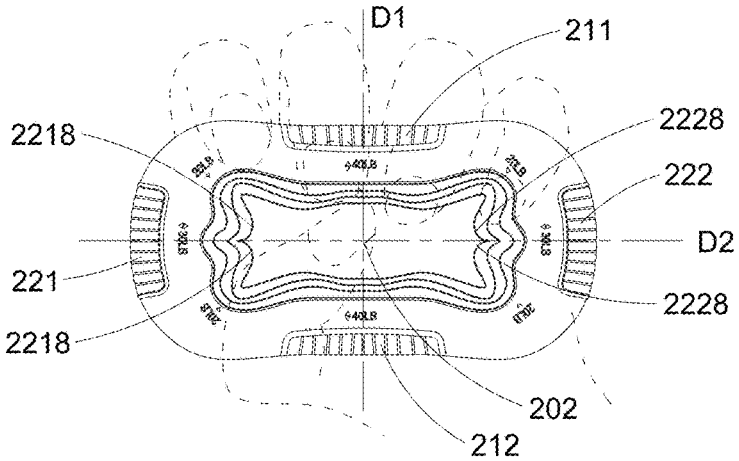

Accordingly, the second gripping group 22 has a third group of concave grooves 2215 and 2225 formed at an inner side facing toward the central cavity 201, so that as shown in FIGS. 13A to 13C of the drawings, when the user is holding on the two gripping portions of the first gripping portion group 21 and pressing along the first direction D1 to allow the two gripping portions of the first gripping portion group 21 to move toward each other. The two gripping portions of the second gripping group 22 are deformed in a manner that each of the two gripping portions of the second gripping group 22 is bending and folding with respect to the second direction D2 along the third centerline 2210 and the fourth centerline 2220 until the two transition surfaces at the two opposite sides of each centerline are having contact with each other. In other words, the introduction of the second group of concave grooves 2215 and 2225 is able to guide and allow the deformation of the second gripping group 22 with respect to the second direction D2.

In this embodiment, the first gripping portion 211 comprises a first central portion 2119 defined between the two first peak positions 2117, the second gripping portion 212 comprises a second central portion 2129 defined between the two second peak positions 2127, the third gripping portion 221 comprises a third central portion 2219 defined between the two third peak positions 2217, and the fourth gripping portion 221 comprises a fourth central portion 2229 defined between the two fourth peak positions 2227. In this embodiment, the first central portion 2119 is symmetrical to the second central portion 2129, the third central portion 2219 is symmetrical to the fourth central portion 2229. The central portions determine the elastic characteristic of the corresponding gripping portion group.

More specifically, as an example, an area size of a cross section along first centerline 2110 and the second centerline 2120 is smaller than an area size of a cross section along third centerline 2210 and the fourth centerline 2220, so that the elastic characteristics of the first central portion 2119 and the second gripping portion 212 is different from the elastic characteristics of the third central portion 2219 and the fourth central portion 2229.

In this embodiment, because of the cross section size differences, a rated force value of the hand gripper ring 2 in the first direction D1 is depend on the deformation of the second gripping group 22, a rated force value of the hand gripper ring 2 in the second direction D2 is depend on the deformation of the first gripping portion group. In this embodiment, the rated force value of the hand gripper ring 2 in the first direction D1 is 40 pounds while the rated force value of the hand gripper ring 2 in the first direction D2 is 30 pounds. Correspondingly, the maximum force required by the user when holding the first grip portion group 21 for exercise along the first direction D2 is larger than the maximum force required by the user when holding the second grip portion group 22 for excise along the second direction D2.

Furthermore, in this embodiment of the present invention, the at least two grip portion groups comprises a third grip portion group 23 and a fourth grip portion group 24. The elastic properties of the first grip portion group 21, the second grip portion group 22, the third grip portion group 23, and the fourth grip portion group 24 are different.

The two gripping parts of the third grip portion group 23 are respectively defined as a fifth gripping portion 231 and a sixth gripping portion 232. The two gripping parts of the fourth grip portion group 24 are respectively defined as a seventh gripping portion 241 and an eighth gripping portion 242. The fifth gripping portion 231 and the sixth gripping portion 232 are arranged in the third direction D3 and are at two opposite sides of the center 202 of the gripper ring body 20. The seventh gripping portion 241 and the eighth gripping portion 242 are arranged in the fourth direction D4 and are at two opposite sides of the center 202 of the gripper ring body 20.

Preferably, the fifth gripping portion 231 and the sixth gripping portion 232 may be symmetrical with respect to the center 202 of the gripper ring body 20, the seventh gripping portion 241 and the eighth gripping portion 242 may be symmetrical with respect to the center 202 of the gripper ring body 20.

The fifth gripping portion 231 has a fifth centerline 2310 and a fifth concave groove 2311 at an inner side thereof, an inner surface 2313 of the fifth gripping portion 231 has a fifth valley position 2312 in the fifth concave groove 2311, the inner surface 2313 of the fifth gripping portion 231 can be an arc surface with two portions 23131 at two sides of the fifth valley position 2312.

The sixth gripping portion 232 has a sixth centerline 2320 and a sixth concave groove 2321 at an inner side thereof, an inner surface 2323 of the sixth gripping portion 232 has a sixth valley position 2322 in the sixth concave groove 2321, the inner surface 2323 of the sixth gripping portion 232 can be an arc surface with two portions 23231 at two sides of the sixth valley position 2322.

The seventh gripping portion 241 has a seventh centerline 2410 and a seventh concave groove 2411 at an inner side thereof, an inner surface 2413 of the seventh gripping portion 241 has a seventh valley position 2412 in the seventh concave groove 2411, the inner surface 2413 of the seventh gripping portion 241 can be an arc surface with two portions 24131 at two sides of the seventh valley position 2412.

The eighth gripping portion 242 has an eighth centerline 2420 and an eighth concave groove 2421 at an inner side thereof, an inner surface 2423 of the eighth gripping portion 242 has an eighth valley position 2422 in the eighth concave groove 2421, the inner surface 2423 of the eighth gripping portion 242 can be an arc surface with two portions 24231 at two sides of the eighth valley position 2422.

The fifth gripping portion 231 and the sixth gripping portion 232 are arranged in a third direction D3 passing through the center 202, the fifth centerline 2310 and the sixth centerline 2320. The seventh gripping portion 241 and the eighth gripping portion 242 are arranged in a fourth direction D4 passing through the center 202, the seventh centerline 2410 and the eighth centerline 2420. The third direction D3 is perpendicular to the fourth direction D4.

The gripping portions of the first gripping portion group 21, the second gripping portion group 22, the third gripping portion group 23, and the fourth gripping portions group 24 are arranged along a circumferential direction to form the hand gripper ring 20 and are distinguishable from each other by different surface patterns. Each gripping portion of the third gripping portion group 23 and the fourth gripping portion group 24 is formed between a gripping portion of the first gripping portion group 21 and a gripping portion of the second gripping portion group 22, and can have a smooth flat surface pattern which is different from the surface patterns 2113 and 2123.

When the user is holding on the two gripping portions of the third gripping portion group 23 and pressing along the third direction D3 to allow the two gripping portions of the third gripping portion group 23 to move toward each other. The two gripping portions of the fourth gripping group 24 are deformed in a manner that each of the two gripping portions of the fourth gripping group 24 is bending and folding with respect to the fourth direction D4 along the seventh centerline 2410 and the eighth centerline 2420 until the two portions of the corresponding inner surface at the two opposite sides of each centerline are having contact with each other. In other words, the introduction of the fourth group of concave grooves 2411 and 2421 is able to guide and allow the deformation of the fourth gripping group 24 with respect to the fourth direction D4.

Figure 15A:
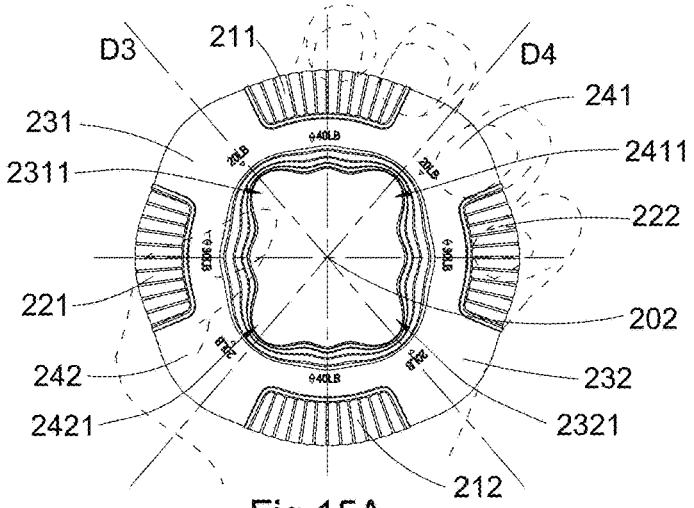
FIGS. 15A, 15B and 15C are schematic views illustrating the hand gripper ring being gripped along a fourth direction according to the above second embodiment of the present invention.
Figure 15B:
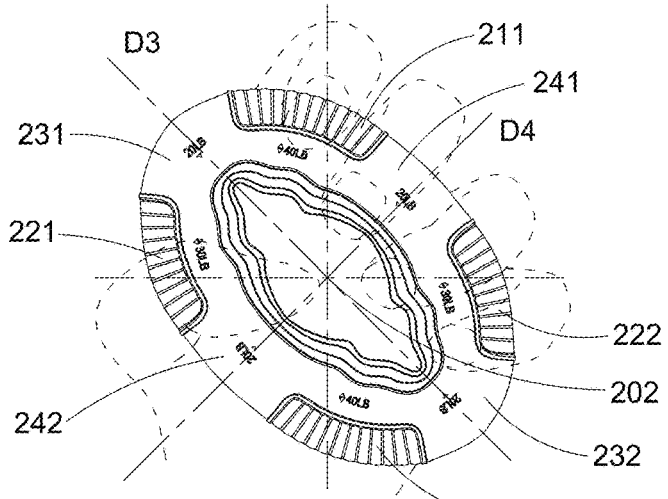
Figure 15C:
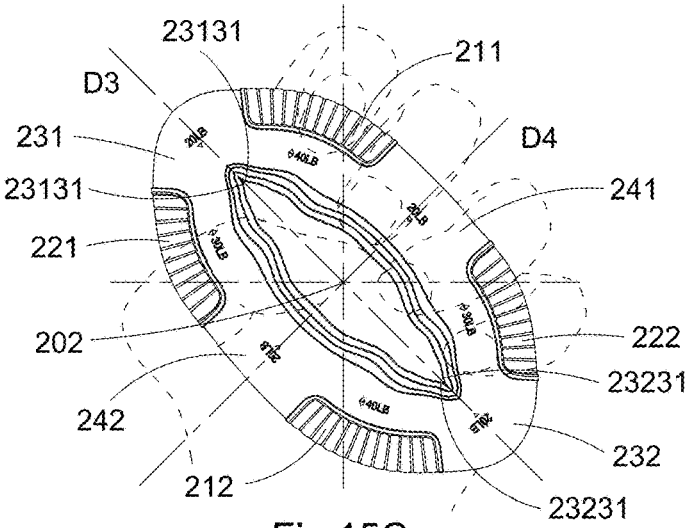

As shown in FIGS. 15A to 15C, when the user is holding on the two gripping portions of the fourth gripping portion group 24 and pressing along the fourth direction D4 to allow the two gripping portions of the fourth gripping portion group 24 to move toward each other. The two gripping portions of the third gripping group 23 are deformed in a manner that each of the two gripping portions of the third gripping group 23 is bending and folding with respect to the third direction D3 along the fifth centerline 2310 and the sixth centerline 2320 until the two portions of the corresponding inner surface at the two opposite sides of each centerline are having contact with each other. In other words, the introduction of the third group of concave grooves 2311 and 2321 is able to guide and allow the deformation of the third gripping group 23 with respect to the third direction D3.

In this embodiment, the elastic characteristic of the third gripping portion group 23 may be the same as the elastic characteristic of the fourth gripping portion group 24, but are different from the elastic characteristics of the first gripping portion group 21 and the second gripping portion group 22. The rated force value of each of third gripping portion group 23 and the fourth gripping portion group 24 is embodied as 20 pounds.

In addition, as shown in FIG. 13A, a groove depth H2 of each of the concave grooves of each of third gripping portion group 23 and the fourth gripping portion group 24 can be larger than a groove depth H1 of each of the concave grooves of each of first gripping portion group 21 and the second gripping portion group 22.

An area size of a cross section along each of the centerlines of the third gripping group 23 and the four gripping group 24 is smaller than the area sizes of the cross section along the centerlines of the first gripping portion group 21 and the second gripping group 22, so that the elastic characteristics of the third gripping group 23 and the four gripping group 24 are different from the elastic characteristics of the first gripping portion group 21 and the second gripping group 22.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and are subject to change without departure from such principles. Therefore, this invention comprises all modifications encompassed within the spirit and scope of the following claims.

What is claimed is:

1. A hand grip ring comprising a gripper ring body which comprises:

a first gripping portion group which comprises two gripping portions at two opposite sides of a center of the gripper ring body; and a second gripping portion group which comprises two gripping portions at two opposite sides of the center of the gripper ring body, wherein the two gripping portions of at least one of the first gripping portion group and the second gripping group have concave grooves at an inner side thereof respectively to guide deformation of the two gripping portions, wherein the first gripping portion group and the second gripping portion group have different elastic characteristics;

wherein the first gripping portion group and the second gripping group are arranged to allow a user to grip in two directions which are perpendicular to each other.

2. The hand grip ring according to claim 1, wherein the two gripping portions of each of the first gripping portion group and the second gripping group have concave grooves at an inner side thereof respectively.

3. The hand grip ring according to claim 2, wherein each of the two gripping portions of the first gripping portion group has a centerline, each of the two gripping portions of the second gripping group has a centerline, wherein when said first gripping portion group is griped and pressed along a first direction passing through the centerlines of the two gripping portions of the first gripping portion group, the two gripping portions of the second gripping group are respectively folded with respect to a second direction passing through the centerlines of the two gripping portions of the second gripping group to reduce the corresponding concave grooves, wherein when said second gripping group is griped and pressed along the second direction passing through the centerlines of the two gripping portions of the second gripping group, the two gripping portions of the first gripping portion group are respectively folded with respect to the first direction passing through the centerlines of the two gripping portions of the first gripping portion group to reduce the corresponding concave grooves.

4. The hand grip ring according to claim 3, wherein an inner surface of each of the two gripping portions of the first gripping portion group and the second gripping portion group has a valley position, two peak position at two sides of the valley position, two transition surfaces each is extended between the valley position and the corresponding peak position to define the corresponding concave groove.

5. The hand grip ring according to claim 4, further comprising a third gripping portion group each comprising two gripping portions arranged opposite to each other and a fourth gripping portion group each comprising two gripping portions arranged opposite to each other, wherein the two gripping portions of the third gripping portion group has a concave groove defined between one peak position of the first gripping portion group and one adjacent peak position of the second gripping group.

6. The hand grip ring according to claim 5, wherein a groove depth of the concave groove of each gripping portion of each of the third gripping portion group and the fourth gripping portion group is larger than a groove depth of the concave groove of each gripping portion of each of the first gripping portion group and the second griping group.

7. The hand grip ring according to claim 5, wherein the gripping portions of the first gripping portion group, the second griping group, the third gripping portion group and the fourth gripping portion group are distinguishable through surface patterns.

8. The hand grip ring according to claim 3, wherein the first gripping portion group and the second gripping group are configured to be of different materials, different volumes, or different densities.

9. The hand grip ring according to claim 3, wherein an area size of a cross section along the centerline of each of the two gripping portions of the first gripping portion group is different from an area size of a cross section along the centerline of each of the two gripping portions of the second gripping group.

10. The hand grip ring according to claim 2, wherein each of the two gripping portions of the first gripping portion group has a centerline, each of the two gripping portions of the second gripping group has a centerline, wherein when said first gripping portion group is griped and pressed along a first direction passing through the centerlines of the two gripping portions of the first gripping portion group, the two gripping portions of the second gripping group are respectively folded with respect to a second direction passing through the centerlines of the two gripping portions of the second gripping group to reduce the corresponding concave grooves.

11. The hand grip ring according to claim 10, wherein the first gripping portion group and the second gripping group are configured to be of different materials, different volumes, or different densities.

12. The hand grip ring according to claim 1, further comprising a third gripping portion group each comprising two gripping portions arranged opposite to each other and a fourth gripping portion group each comprising two gripping portions arranged opposite to each other.

13. The hand grip ring according to claim 12, each of the two gripping portions of the third gripping portion group and the fourth gripping portion group is extended between one gripping portion of the first gripping portion group and one gripping portion of the second gripping portion group.

14. The hand grip ring according to claim 13, wherein the third gripping portion group and the fourth gripping group are arranged to allow the user to grip in two directions which are perpendicular to each other.

15. The hand grip ring according to claim 1, wherein an inner surface of each of the two gripping portions of the first gripping portion group has a valley position, two peak position at two sides of the valley position, two transition surfaces each is extended between the valley position and the corresponding peak position to define the corresponding concave groove.

16. The hand grip ring according to claim 1, wherein each of the two gripping portions of the first gripping portion group comprises a gripping body and a protruding portion integrally extended from the gripping body to define the corresponding concave groove.

17. The hand grip ring according to claim 1, further comprising one or more gripping portion group each comprising two gripping portions arranged between the first gripping portion group and the second gripping portion group.

18. A hand grip ring comprising a gripper ring body which comprises:

a first gripping portion having a first concave groove at an inner side thereof defining a first valley position, two first peak positions, and two first transition surfaces each is extended between the first valley position and the corresponding first peak position;

a second gripping portion having a second concave groove at an inner side thereof defining a second valley position, two second peak positions, and two second transition surfaces each is extended between the second valley position and the corresponding second peak position, wherein the first concave groove is aligned with the second concave groove;

a third gripping portion; and a fourth gripping portion opposite to the third gripping portion, wherein when the third gripping portion and the fourth gripping portion are gripped, said first gripping portion and said second gripping portion are respectively deformed to reduce the first concave groove and said second concave groove in a manner that said two first transition surfaces are moved toward each other and said two second transition surfaces are moved toward each other.

19. The hand grip ring according to claim 18, wherein the third gripping portion has a third concave groove at an inner side thereof defining a third valley position, two third peak positions, and two third transition surfaces each is extended between the third valley position and the corresponding third peak position, the fourth gripping portion has a fourth concave groove at an inner side thereof defining a fourth valley position, two fourth peak positions, and two fourth transition surfaces each is extended between the fourth valley position and the corresponding fourth peak position, wherein the third concave groove is aligned with the fourth concave groove, wherein when the first gripping portion and the second gripping portion are gripped, said third gripping portion and said fourth gripping portion are respectively deformed to reduce the third concave groove and said forth concave groove in a manner that said third transition surfaces are moved toward each other and said fourth transition surfaces are moved toward each other.

* * * * *